US010398218B2

(12) United States Patent
Exley

(10) Patent No.: US 10,398,218 B2
(45) Date of Patent: Sep. 3, 2019

(54) HEATED HAIR BRUSH APPARATUS

(71) Applicant: Ontel Products Corporation, Fairfield, NJ (US)

(72) Inventor: Ross Exley, Morristown, NJ (US)

(73) Assignee: Ontel Products Corporation, Fairfield, NJ (US)

( * ) Notice: Subject to any disclaimer, the term of this patent is extended or adjusted under 35 U.S.C. 154(b) by 335 days.

(21) Appl. No.: 15/346,850

(22) Filed: Nov. 9, 2016

(65) Prior Publication Data

US 2018/0125223 A1 May 10, 2018

(51) Int. Cl.

| | |
|---|---|
| ***A45D 24/10*** | (2006.01) |
| ***A46B 15/00*** | (2006.01) |
| ***A45D 20/48*** | (2006.01) |
| ***A45D 2/00*** | (2006.01) |
| ***A46B 9/02*** | (2006.01) |
| ***A46D 1/00*** | (2006.01) |

(52) U.S. Cl.

CPC ..... *A46B 15/003* (2013.01); *A45D 2/001* (2013.01); *A45D 2/002* (2013.01); *A45D 20/48* (2013.01); *A46B 9/023* (2013.01); *A46B 15/0059* (2013.01); *A46D 1/0246* (2013.01); *A46B 2200/104* (2013.01)

(58) Field of Classification Search

CPC ..... A46B 15/003; A46B 15/0059; A46B 2200/104; A46B 9/023; A45D 2/001; A45D 2/002; A45D 2/42; A45D 20/48; A45D 20/08; A45D 20/52; A46D 1/0246

See application file for complete search history.

(56) References Cited

U.S. PATENT DOCUMENTS

| | | | | |
|---|---|---|---|---|
| 959,866 A | | 5/1910 | Keefe | |
| 990,314 A | | 4/1911 | Taylor | |
| 1,258,375 A | | 3/1918 | Stewart | |
| 1,704,959 A | * | 3/1929 | Butler | A45D 24/24 132/115 |
| 3,173,428 A | | 3/1965 | Postel | |
| 4,032,747 A | | 6/1977 | Kunz | |
| 4,114,222 A | | 9/1978 | Serediuk | |

(Continued)

FOREIGN PATENT DOCUMENTS

| | | |
|---|---|---|
| CN | 201200078 Y | 3/2009 |
| CN | 201337073 Y | 11/2009 |

(Continued)

*Primary Examiner* — Rachel R Steitz

(74) *Attorney, Agent, or Firm* — John S. Artz; Dickinson Wright PLLC

(57) ABSTRACT

A heated hair brush apparatus. A base plate is disposed at a head portion of a housing and has an upper face and a lower face. A plurality of heating elements each extends from the upper face of the base plate to a terminal end. A heat source is disposed in the compartment for transmitting heat through the heating elements. The heating elements and the base plate define a plurality of bores. A plurality of spacers of a material that has a lower thermal conductivity than the heating elements are each received by one of the bores of the base plate. Each of the spacers taper inwardly along at least a portion of the spacer toward the distal end for wedging the spacer in the bore of the heating element to inhibit movement of the spacer relative to the heating element.

19 Claims, 9 Drawing Sheets

(56) References Cited

U.S. PATENT DOCUMENTS

| | | | |
|---|---|---|---|
| 4,126,143 | A | 11/1978 | Schroeder |
| 4,217,915 | A | 8/1980 | Gress |
| D270,381 | S | 8/1983 | Muller et al. |
| 4,623,779 | A | 11/1986 | Raab |
| 5,673,710 | A | 10/1997 | Schaefer et al. |
| 8,448,651 | B2 | 5/2013 | Honnefeller et al. |
| 2005/0109755 | A1 | 5/2005 | Rachal |
| 2014/0332023 | A1 | 11/2014 | Kaizuka |
| 2015/0101139 | A1 | 4/2015 | Guy-Rabi et al. |

FOREIGN PATENT DOCUMENTS

| | | | |
|---|---|---|---|
| CN | 102150990 | B | 12/2014 |
| CN | 204541148 | U | 8/2015 |
| JP | 3203469 | U | 3/2016 |
| TW | M52084 | U | 5/2016 |
| WO | 2013171732 | A1 | 11/2013 |
| WO | 2013171750 | A1 | 11/2013 |
| WO | 2015043489 | A1 | 4/2015 |

* cited by examiner

HEATED HAIR BRUSH APPARATUS

TECHNICAL FIELD

A heated hair brush apparatus. More particularly, a heated hair brush that includes a plurality of heating elements and spacers, wherein each of the spacers tapers inwardly along at least a portion of the spacer toward its distal end for wedging the spacer in a bore of the heating element to inhibit movement of the spacer relative to the heating element.

BACKGROUND OF THE DISCLOSURE

Heated hair brushes are known in the art to provide efficient straightening of a user's hair. One such heated hair brush is disclosed in U.S. Patent Application Publication No. US 2015/0101139 to Guy-Rabi et al. which includes a housing that includes a handle portion and a head portion and defines a compartment therein. A base plate is disposed at the head portion of the housing and has an upper face disposed outside of the compartment, and a lower face disposed in the compartment. A plurality of heating elements each extend from the upper face of the base plate to a terminal end. A heat source is disposed in the compartment for transmitting heat through the base plate to the heating elements. During use, the user's hair passes between the heating elements, thereby heating the hair passing therethrough to provide a straightening effect. A plurality of spacers are each attached to an end of the heating element for spacing the scalp of the user from the heating elements to prevent burning of the user's scalp.

There remains room for improvements to such heated hair brushes to make them easier and less expensive to manufacture, and less prone to failure.

SUMMARY OF THE DISCLOSURE

According to an aspect of the disclosure, a heated hair brush is provided that has a simple, modular design that is easily assembled.

According to another aspect of the disclosure, a heated hair brush if provided that utilizes inexpensive materials.

According an aspect of the disclosure, a heated hair brush is provided that includes spacers that are easily and robustly attached to heating elements. More specifically, a plurality of the spacers may be inserted and secured into bores of the heating elements at once. Thus, the spacers advantageously do not require an adhesive or other fastener to be secured in the bores and a robust connection between the spacers and heating elements may be quickly provided.

In accordance with these and other aspects of the disclosure, a heated hair brush apparatus is provided. The heated hair brush apparatus includes a housing that defines a compartment and includes a head portion. A base plate is disposed at the head portion of the housing. The base plate has an upper face disposed outside of the compartment and a lower face disposed in the compartment. A plurality of heating elements each extend from the upper face of the base plate to a terminal end. A heat source is disposed in the compartment for transmitting heat through the lower face to the heating elements. The heating elements and the base plate define a plurality of bores that each extend through the terminal end of one of the heating element, and through the lower face of the base plate. A plurality of spacers of a material that has a lower thermal conductivity than the heating elements is received by one of the bores of the base plate and extends between a proximal end in the compartment, and past the terminal end of the heating element to a distal end. Each of the spacers tapers inwardly along at least a portion of the spacer toward the distal end for wedging the spacer in the bore of the heating element to inhibit movement of the spacer relative to the heating element.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE EXAMPLE EMBODIMENT

Figure 1:
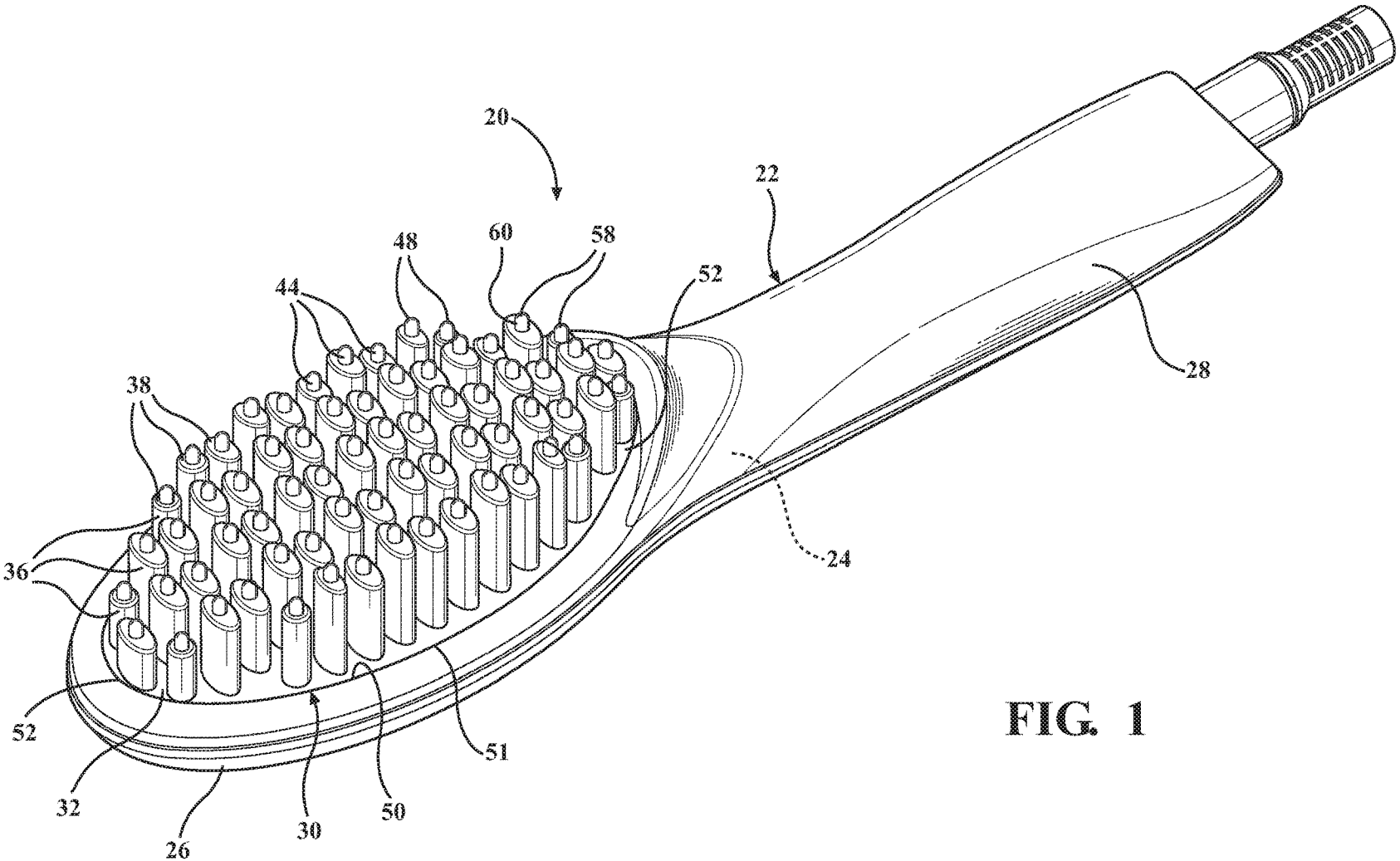
FIG. 1 is a top perspective view of an example embodiment of a heated hair brush apparatus, according to an aspect of the disclosure.

Referring to the Figures, wherein like numerals indicate corresponding parts throughout the several views, a heated hair brush apparatus 20 is generally shown.

The heated hair brush apparatus 20 generally includes a housing 22 that defines a compartment 24 and includes a head portion 26 and a handle portion 28. A base plate 30 is disposed at the head portion 26 of the housing 22 and has an upper face 32 disposed outside of the compartment 24 and a lower face 34 disposed in the compartment 24. A plurality of heating elements 36 each extend from the upper face 32 of the base plate 30 to a terminal end 38. A heat source 40 is disposed in the compartment 24 for transmitting heat through the lower face 34 and to the heating elements 36. The heating elements 36 and the base plate 30 define a plurality of bores 42 that each extend through the terminal end 38 of one of the heating element 36, and through the lower face 34 of the base plate 30. A plurality of spacers 44 of a material that has a lower thermal conductivity than the material of the heating elements 36 are each received by one of the bores 42 of the base plate 30 and extend between a proximal end 46 in the compartment 24 and past the terminal end 38 of the heating element 36 to a distal end 48. Each of the spacers 44 taper inwardly along at least a portion of the spacer 44 toward the distal end 48 for wedging the spacer 44 in the bore 42 of the heating element 36 to inhibit movement of the spacer 44 relative to the heating element 36.

During use of the subject heated hair brush apparatus 20, the plurality of heating elements 36 are heated by the heat source 40. As a user brushes his or her hair with the subject hair brush apparatus 20, the user's hair passes between the heating elements 36, thereby heating the hair passing therethrough to provide a straightening effect. Because the spacers 44 extend past the terminal end 38 of the heating elements 36, they space the scalp of the user from the heating elements 36 to prevent the user's scalp from getting burned.

More specifically, with reference to FIG. 1, the housing 22 defines the compartment 24 and includes both the head portion 26 and the handle portion 28. The housing 22 may be made of an organic polymer material, however, other materials may be utilized. The head portion 26 defines an opening 50 that may have an oval shape. It should be appreciated that the opening 50 could have other shapes including, but not limited to, a rectangular shape or a square shape.

Figure 2:
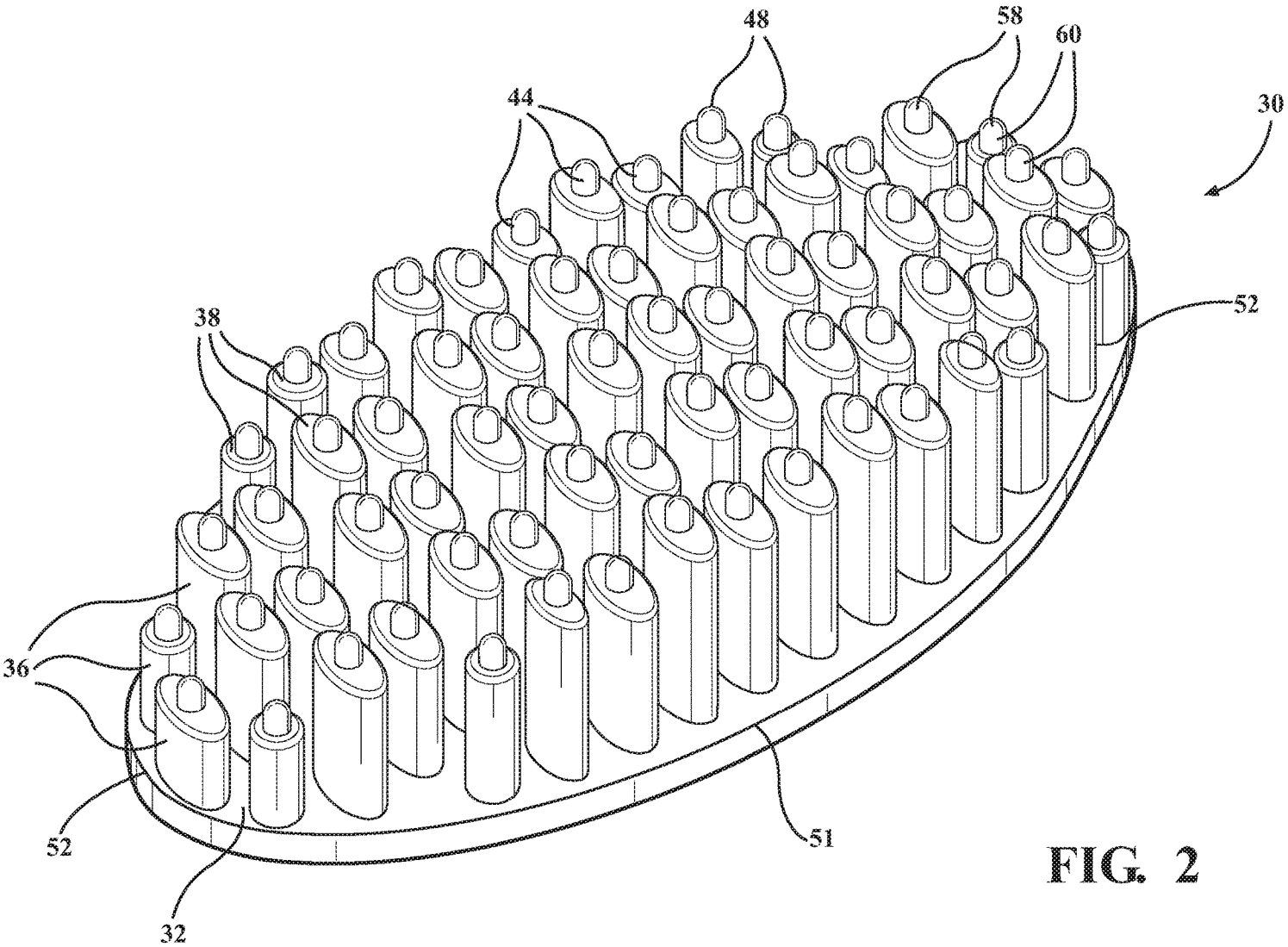
FIG. 2 is a top perspective view of a base plate and spacers that are received by heating elements that extend from the base plate, according to an aspect of the disclosure.
Figure 3:
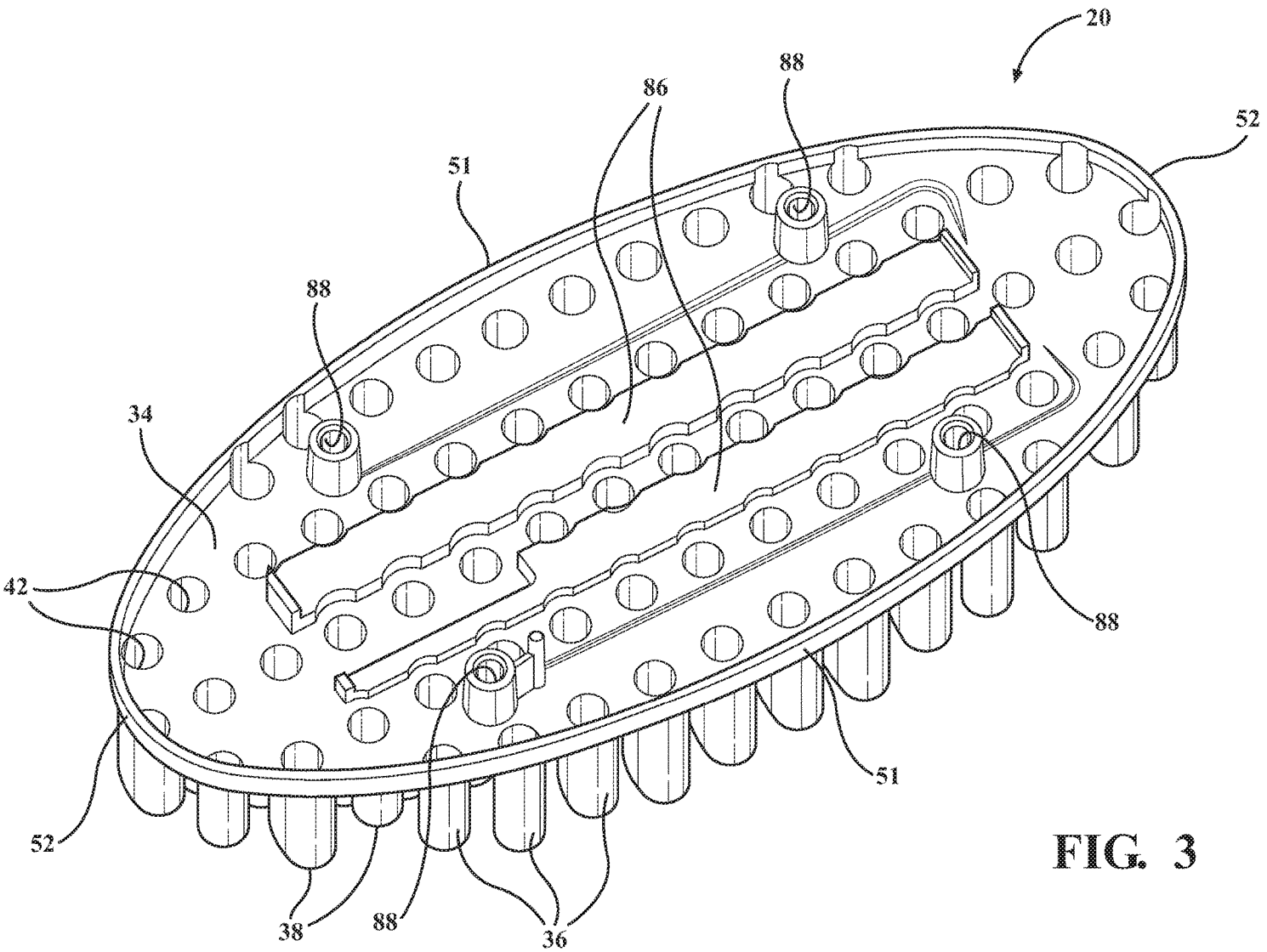
FIG. 3 is a bottom perspective view of the base plate of FIG. 2 without spacers received in the heating elements.

With reference to FIGS. 1-3, the base plate 30 is received in the opening 50 with the upper face 32 of the base plate 30 disposed outside of the compartment 24, and a lower face 34 of the base plate 30 disposed inside the compartment 24. The base plate 30 may have an oval shape, and may present a pair of sides 51 that extend between a pair of ends 52. It should be appreciated that the base plate 30 could have other shapes, e.g., a square or rectangular shape, however, its shape should match that of the opening 50. Furthermore, the base plate 30 may be made of a ceramic material, however, it should be appreciated that the base plate 30 may be made of other materials, but the chosen material should allow a predetermined amount of heat to be transferred therethrough to the heating elements 36.

Figure 4:
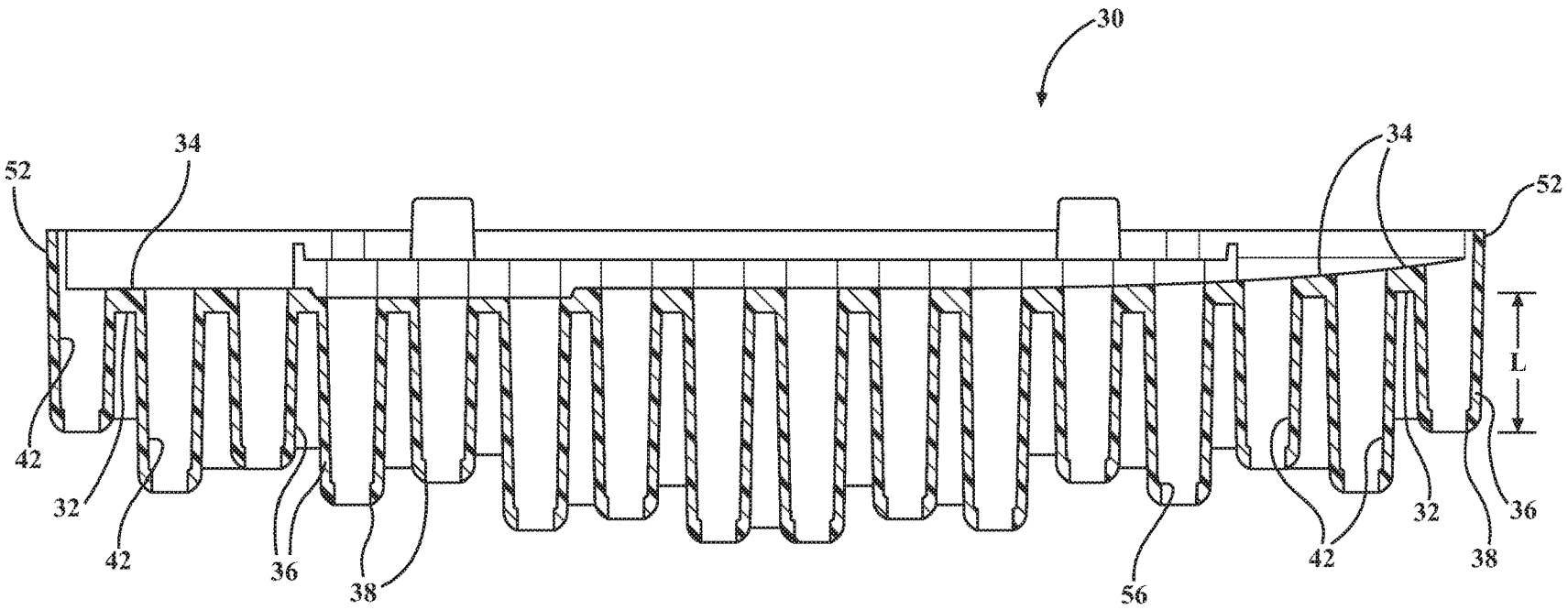
FIG. 4 is a side cross-sectional view of the base plate of FIG. 2 without spacers received in the heating elements.

As best illustrated in FIG. 4, the plurality of heating elements 36 extend from the upper face 32 of the base plate 30 along a length L to the terminal end 38. Each of the heating elements 36 may be made of the same material as the base plate 30 and may be integrally connected with the upper face 32. As illustrated, the heating elements 36 may be disposed in parallel relationship with one another, however, it should be appreciated that the heating elements 36 may extend at other angles relative to one another.

The heating elements 36 and the base plate 30 define the plurality of the bores 42. More specifically, each of the bores 42 extends through the terminal end 38 of one of the heating elements 36 and through the lower face 34 of the base plate 30.

Figure 5:
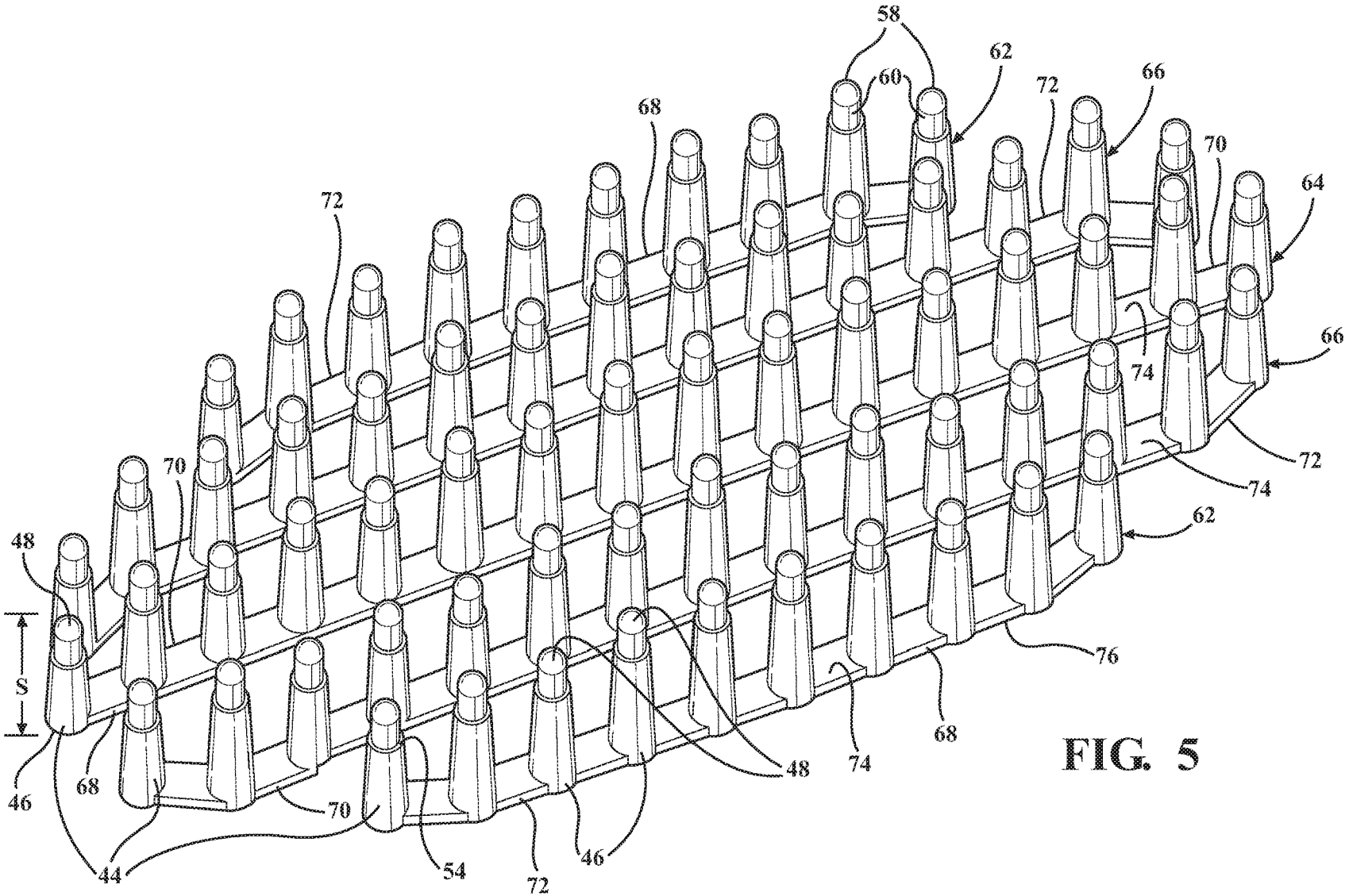
FIG. 5 is a top perspective view of a plurality of groups of spacers and support members, according to an aspect of the disclosure.
Figure 9:
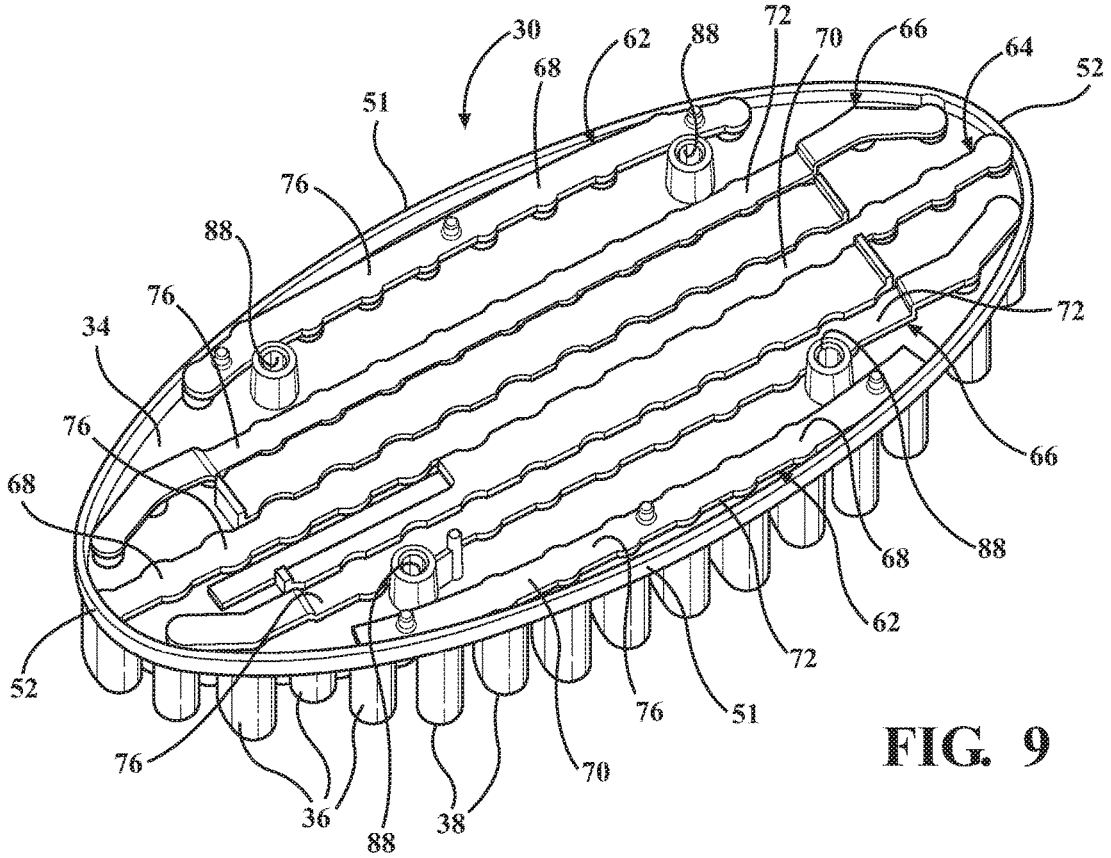
FIG. 9 is a bottom perspective view of a base plate, according to an aspect of the disclosure, with a pair of securement members disposed thereon and a plurality of spacers received in bores defined by the base plate.
Figure 10:
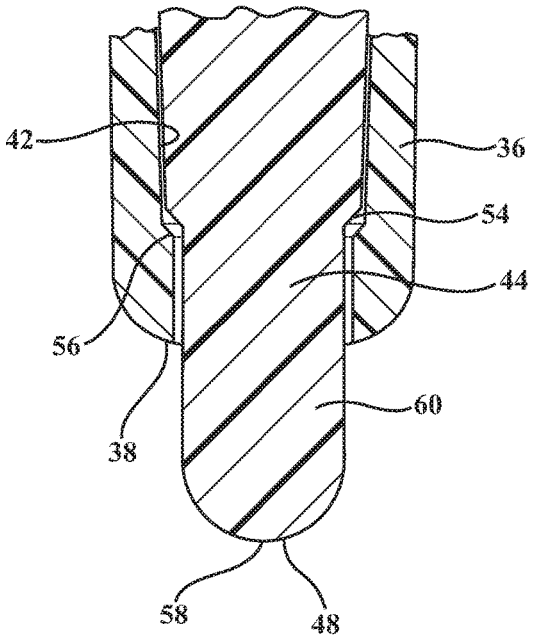
FIG. 10 is a side cross-sectional view of a heating element receiving a spacer in a bore, according to an aspect of the disclosure.

As best illustrated in FIGS. 2, 9 and 10, the plurality of the spacers 44 are each received by one of the bores 42 of the base plate 30. Each of the spacers 44 extend between its proximal end 46 in the compartment 24, and past the terminal end 38 of the heating element 36 to its distal end 48. As illustrated in FIG. 5, a span S of each of the spacers 44 is defined between its proximal end 46 and distal end 48.

Each of the spacers 44 may be made of an organic polymer material. It should be appreciated, however, that the spacers 44 could be made of various other materials, but the chosen material should have a lower thermal conductivity than that of the heating elements 36 and base plate 30. Further, the thermal conductivity of the chosen material should be low enough such that during use of the heated hair brush apparatus 20, the spacers 44 prevent the burning of a user's scalp by spacing the heating elements 36 from the scalp of the user.

As best illustrated in FIGS. 5-8, each of the spacers 44 tapers inwardly along at least a portion of the spacer 44 toward the distal end 48. The tapered shape of each of the spacers 44 allows the spacer 44 to be wedged into the bore 42 of the heating element 36 to inhibit movement of the spacer 44 relative to the heating element 36. With reference to FIGS. 4 and 10, each of the bores 42 may correspondingly taper inwardly toward the terminal end 38 of the heating element 36 along at least a portion of the bore 42. This may provide a nesting relationship between the bores 42 and the spacers 44 inserted therein.

It should be appreciated that the wedge shapes of the spacers 44 and bores 42 allows the spacers 44 to easily be received by the bores 42 and into engagement with the heating elements 36 with the distal end 48 of the spacers 44 extending past the terminal ends 38 of the heating elements 36 during assembly of the subject hair brush apparatus 20. Further, the wedge shape of the spacers 44 and bores 42 provides a robust attachment between the spacers 44 and heating elements 36, thereby preventing the spacers from falling out of the bores 42. This is advantageous over conventional heated hair brushes, which often utilize an adhesive to secure spacers to heating elements.

As best illustrated in FIG. 10, a lip 56 may extend inwardly into each of the bores 42 adjacent to the terminal end 38 of each of the heating elements 36. In the example embodiment, the lip 56 has an annular shape, however it should be appreciated that the lip 56 could have other shapes. Further, it should be appreciated that the lip 56 could be broken up into multiple segments. Each of the spacers 44 may define an inwardly extending shoulder 54 adjacent to the distal end 48 that engages the lip 56 of the bores 42 to further inhibit movement of the spacer 44 relative to the heating element 36. As shown, the shoulder 54 may be tapered toward the distal end 48 of the spacer 44.

As best illustrated in FIG. 5, the tapered portion of each of the spacers 44 is defined between the proximal end 46 and the shoulder 54. It should be appreciated, however, that the tapered portion could be defined at other segments of the length L of the spacers 44.

Each of the spacers 44 further defines a tip 58 that has a semi-spherical shape at the distal end 48, and a cylindrical portion 60 between the shoulder 54 and the tip 58. It should be appreciated that the semi-spherical shape of the tip 58 provides a smooth surface for engagement with the scalp of the user.

As further illustrated in FIG. 5, the spacers 44 are divided into a plurality of groups 62, 64, 66 of spacers 44 with the spacers 44 of each group 62, 64, 66 connected to one another by a support member 68, 70, 72. More specifically, the proximal end 46 of each of the spacers 44 may be connected to a top surface 74 of the support member 68, 70, 72.

As best illustrated in FIG. 9, in the assembled position, the top surface 74 of each of the support members 68, 70, 72 engages the lower face 34 of the base plate 30, and a bottom surface 76 of each of the support members 68, 70, 72 is pointed away from the lower face 34. Accordingly, the spacers 44 of each group 62, 64, 66 may easily, and quickly be inserted into their corresponding bores 42 by lining the support member 68, 70, 72 into its appropriate position and orientation along the lower face 34 of the base plate 30 and engaging the upper top surface 74 of the support member 68, 70, 72 against the lower face 34 of the base plate 30. It should be appreciated that such an arrangement of spacers 44 is advantageous over conventional spacer arrangements in which the spacers are individually attached to each heating element, since numerous spacers 44 of the subject arrangement may be inserted at the same time as one another. This advantageously provides a quick assembly process of the subject heated hair brush apparatus 20.

With reference to FIGS. 5-9, the groups 62, 64, 66 of spacers 44 include a pair of outside groups 62 that are each disposed adjacent to one of the sides 51 of the base plate 30, a central group 64 that extends between the ends 52 of base plate 30, and a pair of intermediate groups 66 that are each disposed between one of the outside groups 62 and the central group 64.

Figure 6:
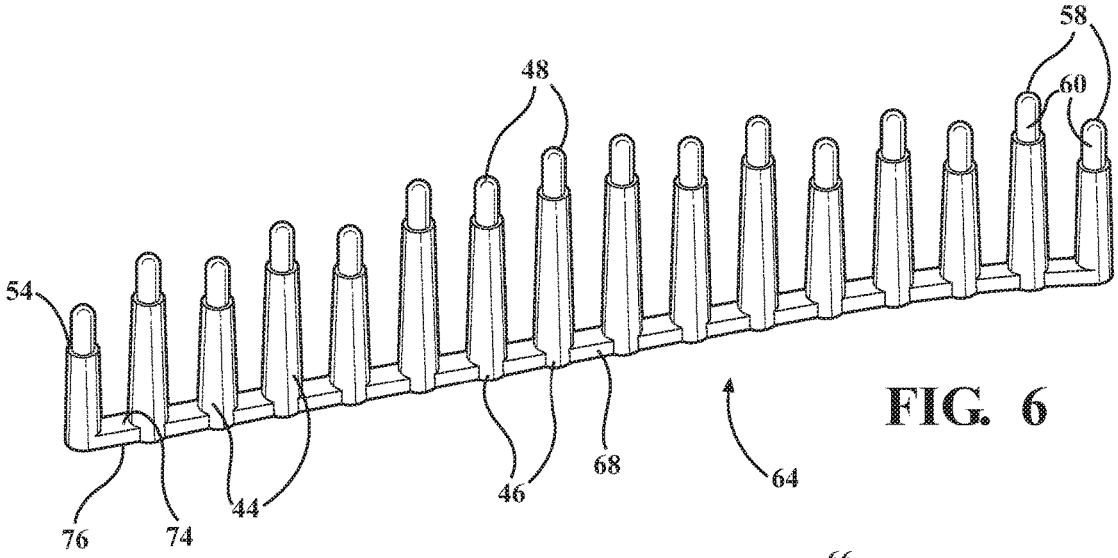
FIG. 6 is a side perspective view of a central group of spacers and a central support member of FIG. 5.

As best illustrated in FIG. 6, a central support member 68 supports the spacers 44 of the central group 64. The central support member 68 is substantially planar and extending substantially linearly.

Figure 7:
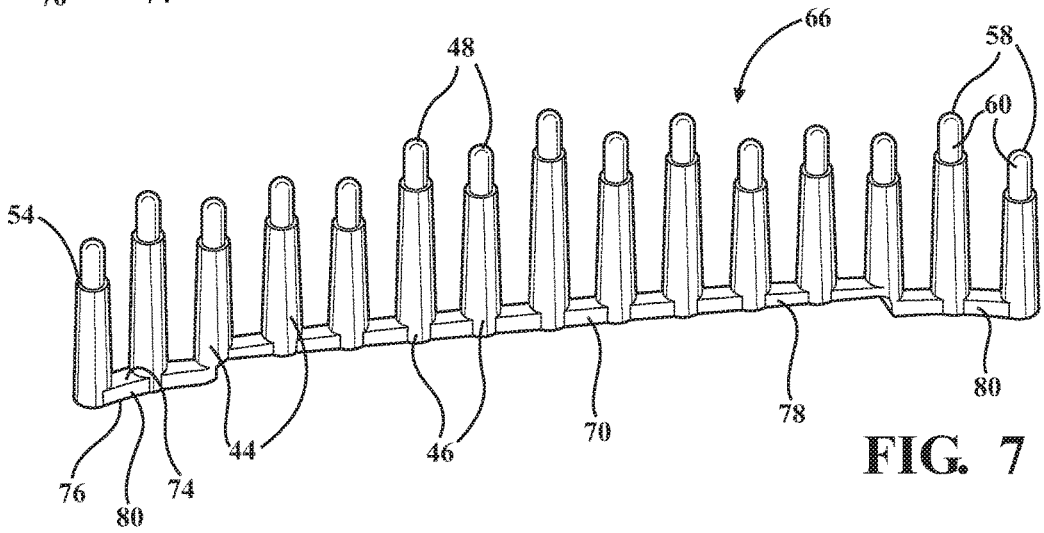
FIG. 7 is a side perspective view of an intermediate group of spacers and an intermediate support member of FIG. 5.

As best illustrated in FIG. 7, an intermediate support member 70 supports the spacers 44 of the intermediate groups 66. Each of the intermediate support members 70 includes an inside portion 78 that is planar and extends substantially linearly as well as a pair of end portions 80 that are each positioned below the inside portion 78 in a direction away from the tip 58 to accommodate for a height difference along the lower face 34 of the base plate 30. The end portions 80 each have an arc-shape for aligning with the outer curvature of the base plate 30.

Figure 8:
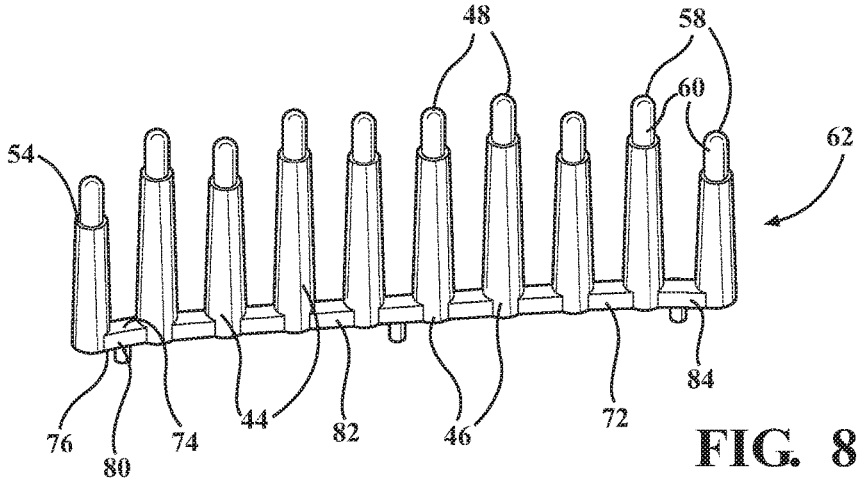
FIG. 8 is a side perspective view of an outside group of spacers and an outside support member of FIG. 5.

As best illustrated in FIG. 8, an outside support member 72 supports the spacers 44 of the outside groups 62. Each of the outside support members 72 has central portion 82 that is planar and extends substantially linearly, and a pair of terminal portions 84 that each have an arc-shape for aligning with the outer curvature of the base plate 30.

With reference to FIG. 3, the base plate 30 includes a pair of generally rectangular-shaped heat transferring members 86 that are integrally connected to the lower face 34 of the base plate 30 and preferably made of the same material as the rest of the base plate 30. The lower face 34 of the base plate 30 further defines a plurality of attachment orifices 88.

Figure 11:
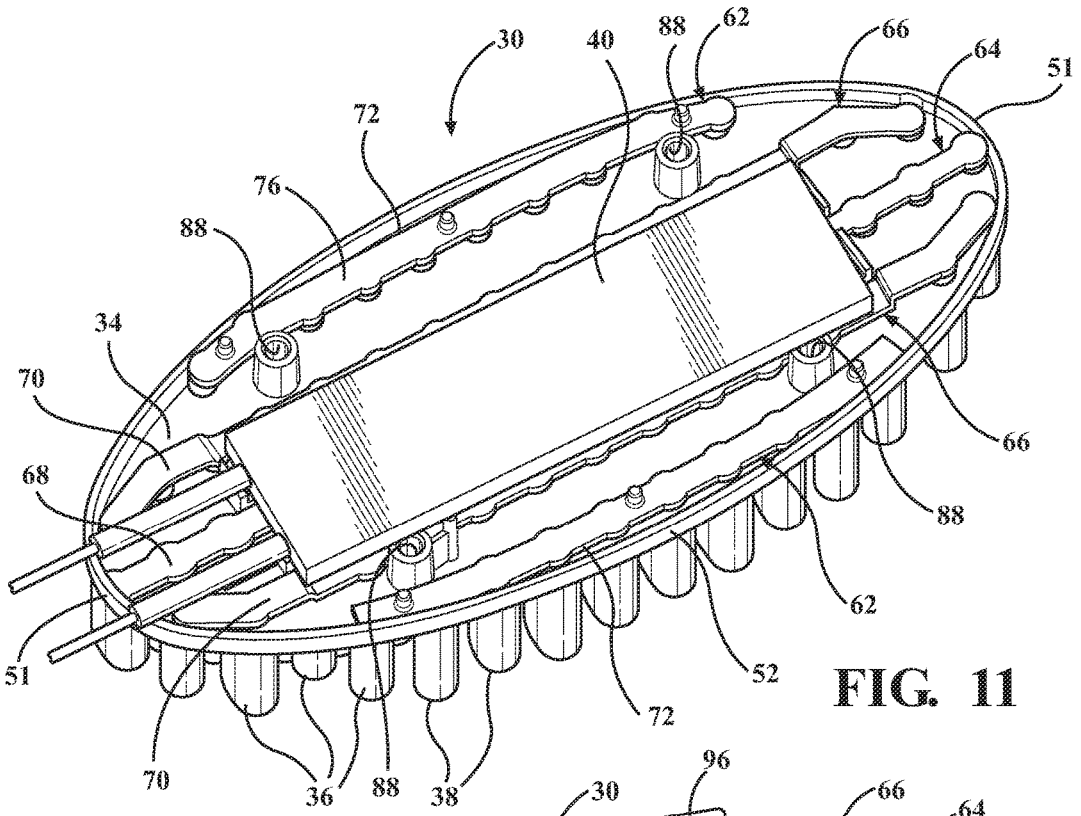
FIG. 11 is a bottom perspective view of a heat source disposed against a base plate, according to an aspect of the disclosure.

With reference to FIG. 11, the heat source 40 may be disposed against the heat transferring members 86 for transmitting heat through the lower face 34 of the base plate 30 to the heating elements 36. In the example embodiment, the heat source 40 is a positive temperature coefficient heater, however it should be appreciated that other types of heat sources could be utilized.

Figure 12:
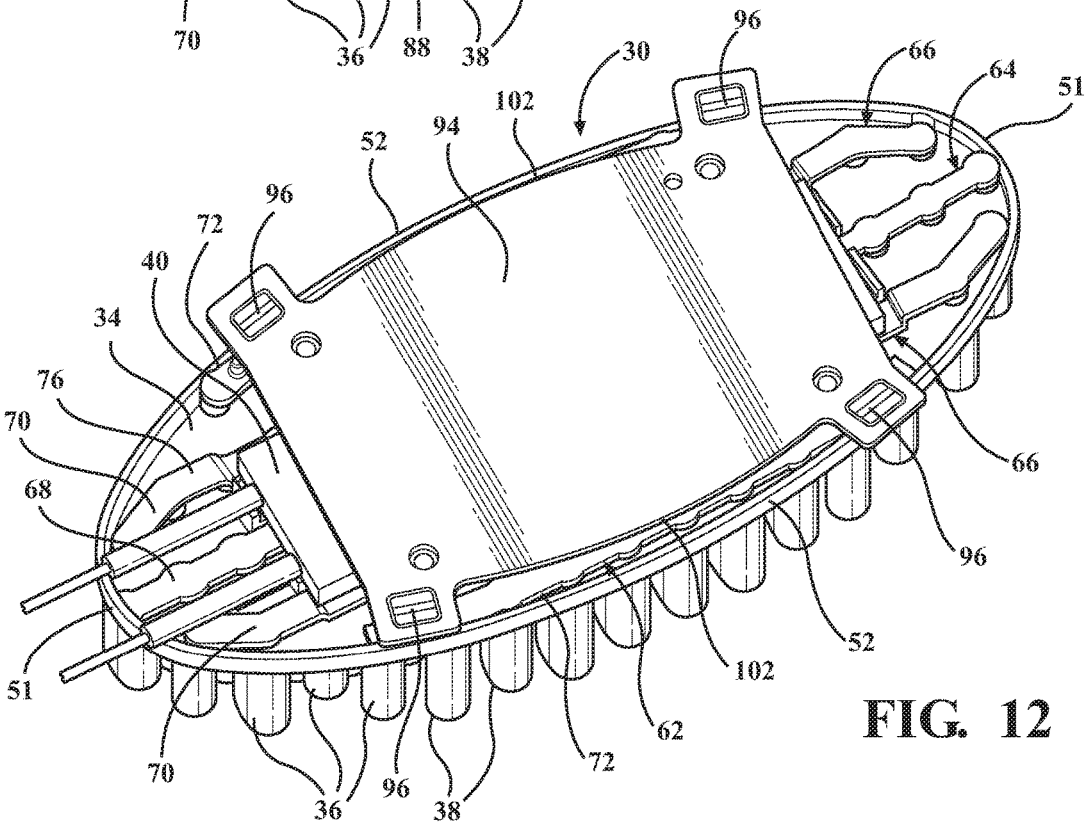
FIG. 12 is a bottom perspective view of a press plate disposed against a heat source, according to an aspect of the disclosure.
Figure 13:
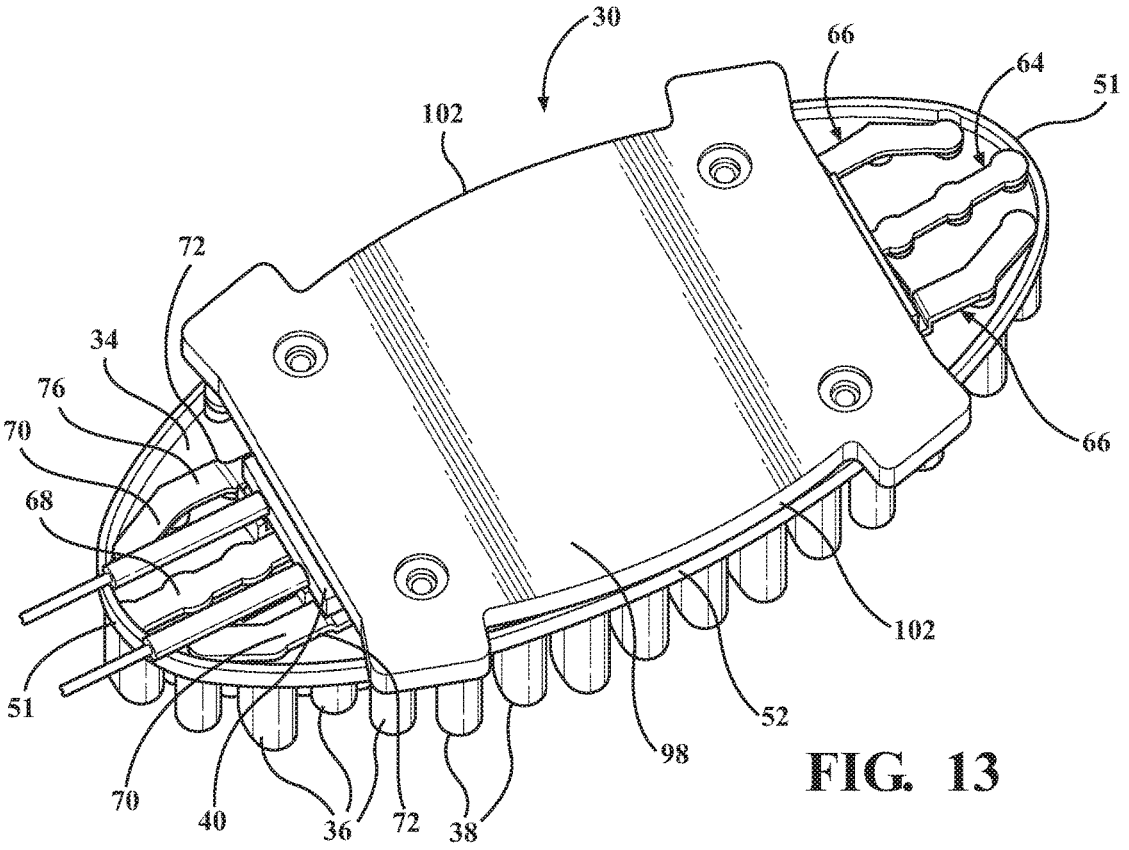
FIG. 13 is a bottom perspective view of a thermal insulation pad disposed against a press plate, according to an aspect of the disclosure.

As best illustrated in FIG. 12, a press plate 94 of a metal material overlies and engages the heat source 40 for biasing the heat source against the heat transferring members 86. It should be appreciated that the press plate 94 could be of other materials. A plurality of tabs 96 extend from the press plate 94. As best illustrated in FIG. 13, a thermal insulation pad 98 overlies and engages the press plate 94 for insulating heat generated by the heater to prevent components disposed in the compartment 24 from being damaged. The thermal insulation pad 98 defines a plurality of detents (not shown), which each are aligned with and receive one of the tabs 96 of the press plate 94 to connect the press plate 94 to the thermal insulation pad 98. Additionally, a plurality of fasteners (not shown) extend through the thermal insulation pad 98 and press plate 94, and into the attachment orifices 88 on the lower face 34 of the base plate 30 to secure the heat source 40, press plate 94 and the thermal insulation pad 98 against one another. It should be appreciated that various types of fasteners including, but not limited to, bolts and adhesives could be utilized.

As best illustrated in FIGS. 12 and 13, the press plate 94 and the thermal insulation pad 98 each have a pair of side edges 102 that are disposed in spaced relationship with one another. The side edges 102 each have a shape that corresponds with the shape of the sides 51 of the base plate 30 to provide a tight fit of the press plate 94 and thermal insulation pad 98 within the compartment 24. In the example embodiment, the side edges 102 generally have an arc-shape to match the oval shape of the sides 51 of the base plate 30, however, it should be appreciated that other shapes could be utilized.

As best illustrated in FIG. 4, the length L of each of the plurality of heating elements 36 may vary. Likewise, as best illustrated in FIG. 5, the span S of the spacers 44 may vary. It should be appreciated that varying the length L and span S of the heating elements 36 and spacers 44 allows the subject heated hair brush apparatus 20 to be configured in a predetermined optimum configuration for a desired straightening effect.

Furthermore, it should be appreciated a plurality of perimeter bristles may be positioned on the head portion 26 of the housing 22 about the base plate 30 to further prevent the scalp of a user from being burned during operation of the subject heated brush apparatus 20.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any sub combination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A heated hair brush apparatus including:

a housing defining a compartment and including a head portion;

a base plate disposed at the head portion of the housing and having an upper face disposed outside of the compartment and a lower face disposed in the compartment;

a plurality of heating elements each extending from the upper face of the base plate to a terminal end;

a heat source disposed in the compartment for transmitting heat through the lower face to the heating elements;

the heating elements and the base plate defining a plurality of bores each extending through the terminal end of one of the heating element and through the lower face of the base plate;

a plurality of spacers of a material having a lower thermal conductivity than the heating elements each received by one of the bores of the base plate and extending between a proximal end in the compartment and past the terminal end of the heating element to a distal end; and each of the spacers tapering inwardly along at least a portion of the spacer toward the distal end and wedged and fixed in the bore of the heating element; each of the bores have a length between the lower face of the base plate and the terminal end of the heating element; wherein the bores of the heating elements each taper radially inwardly along at least a majority of the length of the bore; each of the spacers defines a span between the proximal end and the distal end; and each of the spacers tapers radially inwardly along at least a majority of the span of the spacer.

2. A heated hair brush apparatus as set forth in claim 1 wherein the span of each of the spacers is equal to at least half of the length of the bores.

3. A heated hair brush apparatus as set forth in claim 2 wherein the length of each of the bores has a first tapered portion along which the bore tapers radially inwardly at a first angle and wherein a lip extends inwardly into each of the bores at a second angle being greater than the first angle, the lip being adjacent to the terminal end of the heating elements; the span of each of the spacers has a second tapered portion along which the spacer tapers radially inwardly at the first angle; and each of the spacers defines a shoulder extending radially inwardly adjacent to the distal end of the spacer at a third angle being greater than the first angle and engaging the lip of the bore to further inhibit movement of the spacer relative to the heating element.

4. A heated hair brush apparatus as set forth in claim 3 wherein each of the spacers defines a tip having a semi-spherical shape at the distal end and a cylindrical portion between the shoulder and the tip.

5. A heated hair brush apparatus as set forth in claim 1 wherein the plurality of spacers is divided into a plurality of groups of spacers; and a plurality of support members each interconnect the spacers of the groups of spacers to one another.

6. A heated hair brush apparatus as set forth in claim 5 wherein the proximal end of each of the spacers engages the support member.

7. A heated hair brush apparatus as set forth in claim 6 wherein each of the support members has a top surface and a bottom surface; the spacers connected to the support member extend from the top surface of the support member; and the top surface of the support member engages the lower face of the base plate.

8. A heated hair brush apparatus as set forth in claim 5 wherein the base plate generally has an oval shape and has a pair of sides that are spaced from one another and extend between a pair of ends.

9. A heated hair brush apparatus as set forth in claim 8 wherein the groups include a pair of outside groups of spacers each disposed adjacent to one of the sides of the base plate and connected to one another by an outside support member; and the outside support members of the outside groups each have a central portion being planar and extending substantially linearly and a pair of terminal portions each having an arc-shape for aligning with the curvature of the oval-shaped base plate.

10. A heated hair brush apparatus as set forth in claim 9 wherein the groups further includes a central group of spacers extending between the ends of the base plate and connected to one another by a central support member; and the central support member of the central group of spacers extends substantially planar and linearly.

11. A heated hair brush apparatus as set forth in claim 1 wherein the heat source is disposed against the base plate.

12. A heated hair brush apparatus as set forth in claim 11 wherein the base plate further includes a pair of heat transferring members integrally connected to the lower face of the base plate and in engagement with the heat source for transmitting heat from the heat source to the base plate and the heating elements.

13. A heated hair brush apparatus as set forth in claim 11 wherein a press plate overlies and engages the heater for biasing the heater against the base plate.

14. A heated hair brush apparatus as set forth in claim 13 wherein a thermal insulation pad overlies and engages the press plate for insulating heat generated by the positive temperature coefficient heater.

15. A heated hair brush apparatus as set forth in claim 14 wherein the press plate and the thermal insulation pad each have a pair of side edges disposed in spaced relationship with one another; and wherein the side edges have a shape that corresponds with the shape of the base plate.

16. A heated hair brush apparatus as set forth in claim 1 wherein at least one of the plurality of heating elements extends along a different length between the upper face of the base plate and the terminal end than at least one of the other of the heating elements.

17. A heated hair brush apparatus as set forth in claim 1 wherein at least one of the spacers extends along a different span between the proximal end and the distal end than at least one of the other of the spacers.

18. A heated hair brush apparatus as set forth in claim 1 wherein the heating elements are integrally connected to the base plate.

19. A heated hair brush apparatus including:

a housing defining a compartment and including a head portion;

a base plate disposed at the head portion of the housing and having an upper face disposed outside of the compartment and a lower face disposed in the compartment;

a plurality of heating elements each extending from the upper face of the base plate to a terminal end;

a heat source disposed in the compartment for transmitting heat through the lower face to the heating elements;

the heating elements and the base plate defining a plurality of bores each extending through the terminal end of one of the heating element and through the lower face of the base plate;

a plurality of spacers of a material having a lower thermal conductivity than the heating elements each received by one of the bores of the base plate and extending between a proximal end in the compartment and past the terminal end of the heating element to a distal end;

each of the spacers tapering inwardly along at least a portion of the spacer toward the distal end for wedging the spacer in the bore of the heating element to inhibit movement of the spacer relative to the heating element;

wherein the plurality of spacers is divided into a plurality of groups of spacers; and a plurality of support members each interconnect the spacers of the groups of spacers to one another;

wherein the base plate generally has an oval shape and has a pair of sides that are spaced from one another and extend between a pair of ends;

wherein the groups include a pair of outside groups of spacers each disposed adjacent to one of the sides of the base plate and connected to one another by an outside support member; and the outside support members of the outside groups each have a central portion being planar and extending substantially linearly and a pair of terminal portions each having an arc-shape for aligning with the curvature of the oval-shaped base plate;

wherein the groups further includes a central group of spacers extending between the ends of the base plate and connected to one another by a central support member; and the central support member of the central group of spacers extends substantially planar and linearly;

wherein the groups further includes a pair of intermediate groups of spacers each disposed between one of the outside groups of spaces and the central group and connected to one another by an intermediate support member; and the intermediate support members of the intermediate groups each include an inside portion being planar and extending substantially linearly and a pair of end portions each positioned below the inside portion in a direction away from the tip and having an arc-shape for aligning with the curvature of the oval-shaped base plate.

* * * * *